US005555971A

United States Patent [19]

Takada

[11] Patent Number: 5,555,971

[45] Date of Patent: Sep. 17, 1996

[54] KEY SWITCH

[75] Inventor: Yasuo Takada, Toyama, Japan

[73] Assignee: SMK Corporation, Tokyo, Japan

[21] Appl. No.: 499,053

[22] Filed: Jul. 6, 1995

[30] Foreign Application Priority Data

Dec. 19, 1994 [JP] Japan ..... 6-334463

[51] Int. Cl.[6] ..... H01H 13/70

[52] U.S. Cl. ..... 200/345; 200/344

[58] Field of Search ..... 200/345, 344, 200/341, 512, 517, 520

[56] References Cited

U.S. PATENT DOCUMENTS

| | | | |
|---|---|---|---|
| 5,115,106 | 5/1992 | Weiland et al. | 200/512 |
| 5,256,843 | 10/1993 | Chiba et al. | 200/517 |
| 5,278,371 | 1/1994 | Watanabe et al. | 200/344 |
| 5,298,706 | 3/1994 | English et al. | 200/517 |
| 5,430,263 | 7/1995 | English et al. | 200/512 |

FOREIGN PATENT DOCUMENTS 5342943 12/1994 Japan .

*Primary Examiner*—David J. Walczak

*Attorney, Agent, or Firm*—Pearne, Gordon, McCoy & Granger

[57] ABSTRACT

The invention concerns a keyboard unit which is reduced in thickness, improved in operability, increased in service life, and decreased in manufacturing cost. A key switch comprises: a key top (40); an elastic member (51); a cross link structure (80) made up of an outer link (60) and an inner link (70); a membrane switch sheet (90) is arranged under the elastic member (51); and a frame (100) arranged under the membrane switch sheet (90). In the key switch, the key top (40) has an abutting portion (43) which abuts against the upper surface of the elastic member (51), and the end portions (63) of the outer link (60) and the end portions (73) of the inner link (70) are supported by a pair of fixing portions (101) and another pair of fixing portions (102), respectively, which are raised from the frame (100) and protruded over the membrane sheet (90).

4 Claims, 5 Drawing Sheets

KEY SWITCH

BACKGROUND OF THE INVENTION

1. Field of the Invention

This invention relates to a keyboard unit having a plurality of key switches, and in particular to a thin keyboard unit which is applied, for instance, to a note type personal computer.

2. Description of the Prior Art

A cross link type key switch, as shown in FIGS. 10 and 11, has been disclosed by Japanese Patent Kokai Publication No. 342943/1993.

In the key switch, a key top holder 25 is formed with the outer legs 29 and inner legs 32 of link members 26 and 27 which are coupled to one another in such a manner that the cross angle therebetween changes freely according to the height of a key top, and the engaging protrusions 29*a* and 32*a* of those legs 29 and 32 are engaged with engaging recesses 22*b* and 22*c* formed in the housing 22, respectively.

The key top holder 25 has an operating piece 30 which elastically abuts against an elastic member 24, whereby a membrane switch 16 is operated by the elastic member 24 as the key top 23 is moved up and down.

The above-described key switch suffers from the following difficulties:

The key switch requires, in addition to a supporting board 15 placed below the membrane switch 16 for supporting the latter 16, the housing 22 above the membrane switch 16 for engagement with the key top holder 25 through the engaging recesses 22*b* and 22*c* of the housing 22. Hence, the thickness of the housing 22 makes it difficult to decrease the thickness of the entire key switch.

Further, since, as was described above, the key switch is designed such that the operating piece 30 provided in the key top holder 25 elastically abuts against the elastic member 24, the thickness of the operating piece 30 also makes it difficult to decrease the thickness of the key switch.

Furthermore, since the operating piece 30 provided in the key top holder 25 elastically abuts against the elastic member 24 adapted to drive the membrane switch 26, the clicking feeling which is caused due to deformation of the elastic member 24 when the operator taps the key top 23 is hardly transmitted to the operator.

In the keyboard unit, the elastic member 24 is assembled in each of the key switches. Hence, the assembling work is rather troublesome, and sometimes it may be forgot to assemble the elastic member 24 in the key switch. Thus, the keyboard unit is relatively high in manufacturing cost.

On the other hand, there is a demand for reduction of the number of parts of the keyboard unit, to decrease the part cost and the part managing manhour.

Moreover, in order to prevent the permanent set in fatigue of the elastic member in the key switch, it is necessary to increase the size of the elastic member as much as possible.

In a key switch in which its key top is large in area with respect to the elastic member, an interlocking bar which is a substantially U-shaped metal wire is employed to smoothly operate the key switch. However, the key switch is disadvantageous in that its assembling work is intricate, and the manufacturing cost is accordingly high.

SUMMARY OF THE INVENTION

The above-described problems accompanying a conventional key switch have been solved by the provision of a key switch which includes:

a key top;

a rigid frame having fixing portions;

a membrane switch sheet having a switch section and through-holes, the membrane switch sheet being placed over the rigid frame so that the fixing portions are protruded upwardly from the membrane switch sheet through the through-holes;

coupling means for coupling the key top to the fixing portions to enable downward/upward movement of the key top relative to the membrane switch sheet;

an elastic member provided between the membrane switch sheet and the key top for turning on and off the switch section in response to the downward/upward movement of the key top.

The key switch according to the above-described structure can dispense with the housing (22) provided above the membrane switch sheet, which makes it possible to reduce the thickness of the key switch and decrease the number of components.

In an embodiment of the invention, a key switch includes: a key top; an elastic member in the form of a cup set upside down, which urges the key top upwardly; a cross link structure made up of a substantially U-shaped outer link and a substantially U-shaped inner link which are rotatably coupled to each other at intersections, the cross link structure being rotatably supported below the key top; a membrane switch sheet arranged under the elastic member and having a switch section which is confronted with a depressing portion of the elastic member; and a rigid frame arranged under the membrane switch sheet.

The key top is vertically guided by the cross link structure in such a manner that the key top is moved parallel, thereby to cause the depressing portion to turn on and off the switch section. The key top has an abutting portion on the lower surface thereof, which abuts against the upper surface of the elastic member. The outer link includes a pair of arm portions whose end portions are supported by a pair of rotatably fixing portions which are raised from the frame and protruded over the membrane switch sheet. The inner link similarly includes a pair of arm portions whose end portions are supported by a pair of slidably fixing portions which are raised from the frame and protruded over the membrane switch sheet.

In the embodiment, the cross link structure is supported by the pair of rotatably fixing portions and the pair of slidably fixing portions which are raised from the rigid frame and protruded over the membrane switch sheet. Hence, in the key switch, unlike the conventional one, the housing provided above the membrane switch sheet is eliminated. Accordingly, the key switch can be reduced in thickness, and the number of components can be decreased, with results that the manufacturing cost is decreased, and the number of part managing steps is reduced.

In the case of a key switch in which the area of its key top is large with respect to an elastic member, the interlocking bar which is a substantially U-shaped metal wire can be eliminated which is heretofore employed to make the operation of the key switch smooth, which reduces the manufacturing cost and the part cost.

Furthermore, in the key switch, the abutting portion formed on the lower surface of the key top abuts against the upper surface of the elastic member. Hence, the key switch of the invention dispenses with the operating piece which is provided for the cross link structure of the conventional key switch, and accordingly it is possible to reduce the thickness of the keyboard unit. Further, the click action which, when the key top is tapped with the finger, the elastic member performs is directly transmitted to the operator.

In the key switch of the embodiment, the frame is made of a metal sheet, the end portions are rotatably held in round holes formed in the rotatably fixing portions raised from the frame, the outer link includes a bridging portion having a pair of holding portions at both ends which are slidably held by a pair of slidably holding portions formed on the lower surface of the key top, the end portions of the inner link are slidably held in a pair of elongated holes formed in the slidably fixing portions raised from the frame, and the inner link includes a bridging portion which is rotatably supported by a pair of rotatably holding portions extended from the lower surface of the key top. The frame, being made of a metal sheet, is smaller in thickness than one which is made of synthetic resin.

Furthermore, in the key switch, the elastic member of the key switch together with the elastic members of other key switches are provided on the integral, one-piece rubber sheet. This not only eliminates the troublesome work that the elastic members are assembled in the key switches., respectively, and accordingly the difficulty that it is forgot to assemble the elastic member in the key switch, but also decreases the manufacturing cost. In addition, the number of components is greatly decreased, with results that the part cost is decreased as much, and the part management cost is also reduced.

In addition, in the key switch, the arm portions of the outer link include arcuate portions, respectively, and the arm portions of the inner link includes arcuate portions along the arcuate portions of the arm portions of the outer link, respectively. This arrangement makes it possible to increase the size of the elastic member, with a result that the latter is prevented from the permanent set in fatigue.

DETAILED DESCRIPTION OF THE PREFERRED EMBODIMENT

Figure 1:
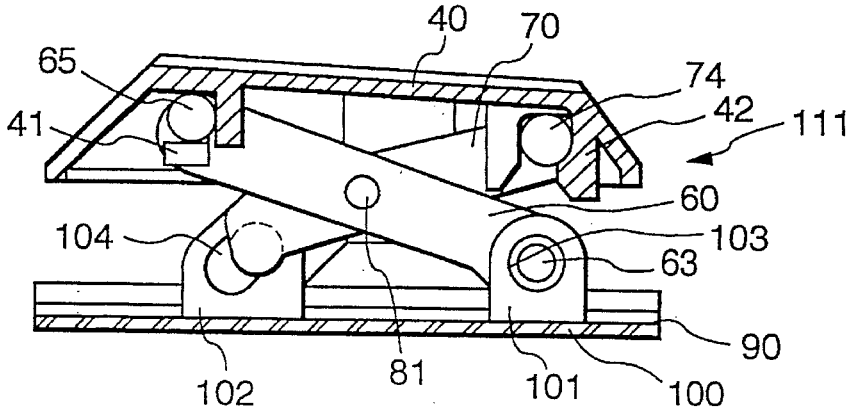
FIG. 1 is a sectional view showing a structure of a key switch according to the invention.
Figure 2:
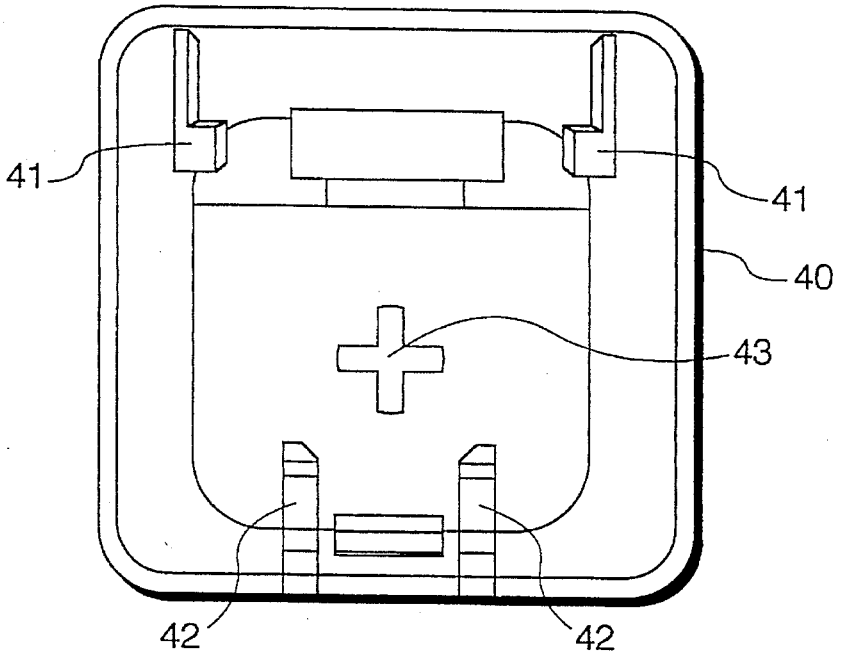
FIGS. 2 and 3 are a bottom view and a sectional view, respectively, showing a key top of the key switch of the invention.

A preferred embodiment of the invention will be described with reference to FIGS. 1 through 9.

A key switch 111 according to the invention comprises a key top 40, an elastic member 51 (FIG. 4), an outer link 60, an inner link 70, a membrane switch sheet 90, and a frame 100.

The key top 40 is formed by injection-molding of synthetic resin such as ABS resin. As shown in FIGS. 1 through 5, the following portions are extended from the lower surface of the key top 40; a pair of portions 41 which slidably hold the holding portions 65 of the outer link 60 (hereinafter referred to as "slidably holding portions 41", when applicable), portions 42 which rotatably hold the bridging portion of the inner link 70 (hereinafter referred to as "rotatably holding portions 42", when applicable), and an abutting portion 43 which abuts against the elastic member 51.

Figure 3:
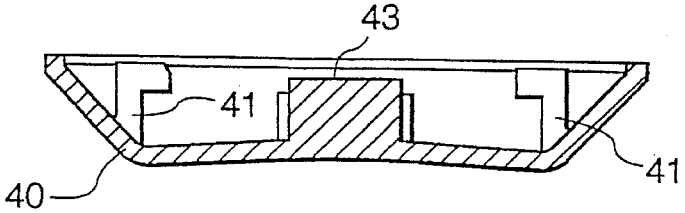

The slidably holding portions 41 are substantially L-shaped as shown in FIG. 3 and slidably holds the holding portions 65 of the outer link 60, while the rotatably holding portions 42, as shown in FIG. 1, rotatably hold the bridging portion 74 of the inner link 70, so that a cross link structure is formed. The cross link structure thus formed allows the vertical parallel displacement of the key top 40.

The slidably holding portions 41 and the rotatably holding portions 42 of the key top 40 can be readily engaged with the holding portions 65 and the bridging portion 74 by snap fitting, respectively.

The configurations of the slidably holding portions 41 and the rotatably holding portions 42 are not always limited to those which are shown in the figures. That is, the configurations may be freely designed as long as the holding portions 65 are slidably held by the slidably holding portions 41 and the bridging portion 74 is rotatably held by the rotatably holding portions 42. Alternatively, they may be so shaped that the holding portions 65 are rotatably held and the bridging portion 74 is slidably held. In addition, the slidably holding portions 41 may be so modified that they slidably hold the bridging portion 64 of the outer link 60.

The abutting portion 43 abuts directly on the top of the elastic member 51. This feature makes it possible to reduce the thickness of the key switch 111, and the click action which, when the key top 40 is tapped with the finger, the elastic member 24 performs is directly transmitted to the operator.

The elastic member 51 is formed by compression-molding of polymeric material such as silicone rubber having elastic characteristic.

A plurality of the elastic members 51; that is, the elastic members 51 of the key switches of the keyboard unit 110 are formed on an integral, one-piece rubber sheet 50 and arranged according to the locations of the corresponding key switches 111. This not only eliminates the troublesome operation that the elastic members are assembled in the key switches 111, respectively, and accordingly the difficulty that it is forgot to assemble the elastic member in the key switch, but also decreases the manufacturing cost. In addition, the number of components is greatly decreased, with results that the part cost is decreased as much, and the part handling cost is also reduced.

Figure 4:
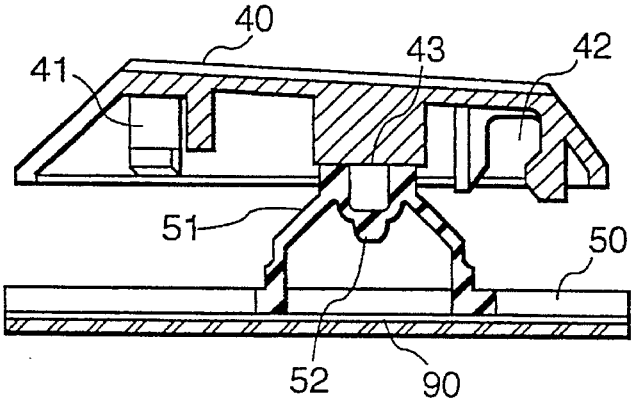
FIG. 4 is a sectional view showing the key switch which is in "off" state.
Figure 5:
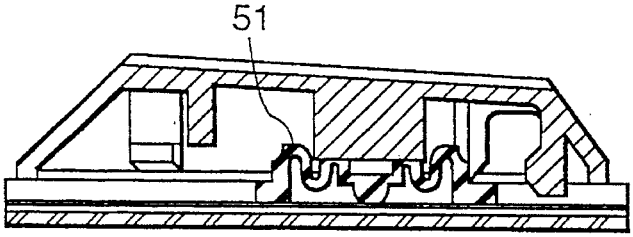
FIG. 5 is also a sectional view showing the key switch which is in "on" state.

When the key switch 111 is in "off" state, the elastic member 51 is like a cup set upside down as shown in FIG. 4. Upon depression of the key top 40, the elastic member 51 is elastically deformed as shown in FIG. 5; that is, the key switch 111 is turned on. When the key top 40 is released, the elastic member 51 is restored like a cup set upside down, to push the key top upward to turn off the key switch 111.

The elastic member 51, as shown in FIG. 4, includes a nipple-shaped depressing portion 52 below the abutting portion 43 of the key top which is extended into the inside of the body of the elastic member 51. As shown in FIG. 5, a switch section of the membrane switch sheet 90 provided under the rubber sheet 50 is arranged confronted with the depressing portion 52, so that the latter 52 causes the stationary contact (not shown) and the movable contact (not shown) of the switch section to make and break. That is, the key switch 111 shown in FIG. 4 is in "off" state, and the key switch 111 shown in FIG. 5 is in "on" state.

The rubber sheet 50 has holes into which the rotatably fixing portions 101 and the slidably fixing portions 102 of the frame 100 are inserted.

Figure 6:
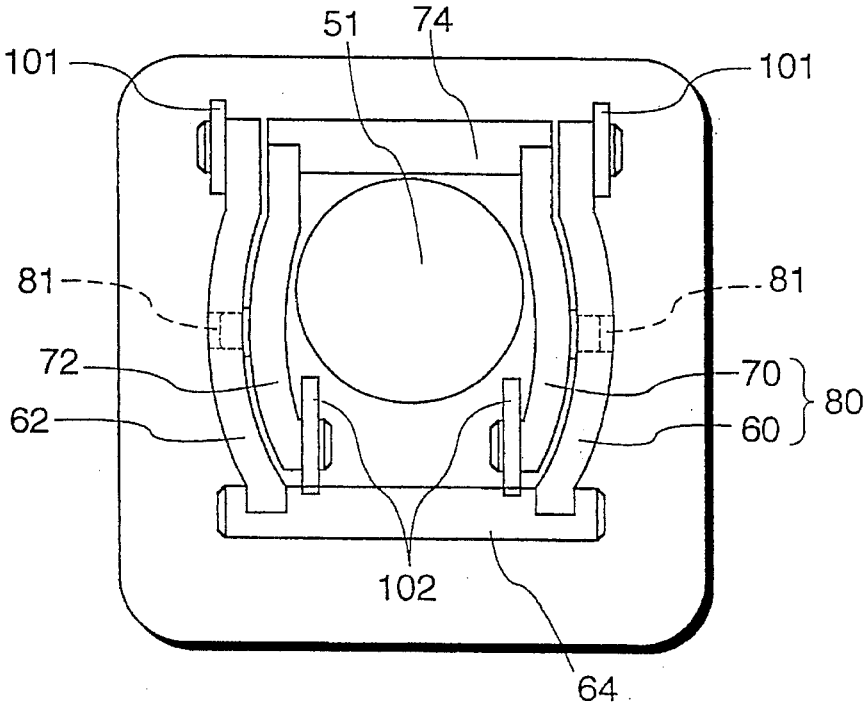
FIG. 6 is a plan view showing the internal structure of the key switch according to the invention.
Figure 7:
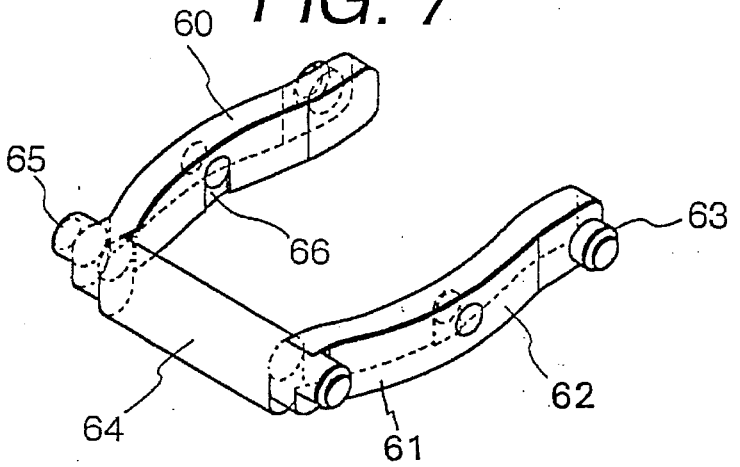
FIG. 7 is a perspective view showing an outer link in the key switch of the invention.

The outer link 60 is formed by injection-molding of synthetic resin such as polyacetal resin. The outer link 60, as shown in FIGS. 6 and 7, is U-shaped, having a pair of arm portions 61 extended from both end of the cylindrical bridging portion 64. Each of the arm portions 61 includes an arcuate portion 62 which is moderately curved outwardly. The arcuate portions 62 make it possible to increase the size of the elastic member 51, thus preventing the permanent set in fatigue of the latter 51.

The arm portions 61 have a pair of cylindrical end portions 63 at the ends, which are rotatably held in round holes 103 formed in the rotatably fixing portions 101 of the frame 100, respectively. More specifically, the diameter of the cylindrical end portions 63 is made slightly smaller than the diameter of the round holes 103, to the extent that the former 63 are rotatably held in the latter 103. As was described before, the bridging portion 64 has the cylindrical holding portions 65 at both ends, which are slidably held by the slidably holding portions 41 of the key top 40.

Each of the arm portions 61 has a round through-hole 66 at the middle. On the other hand, the inner link 70 has arm portions 71 extended from both ends of the bridging portion 74, and each of the arm portions 71 has a cylindrical protrusion 75 at the middle. Those cylindrical protrusions 75 of the inner link 70 are engaged with the round through-holes 66 of the arm portions 61 of the outer link 60. That is, the outer and inner links 60 and 70 are coupled at intersections 81, thus forming a cross link structure 80. The diameter of the through-holes 66 is made slightly larger than the diameter of the cylindrical protrusions 75 to the extent that the outer link 60 and the inner link 70 are rotatably coupled to each other. In this connection, it should be noted that the outer link 60 and the inner link 70 are assembled by use of the elasticity of their arm portions 61 and 71.

Figure 8:
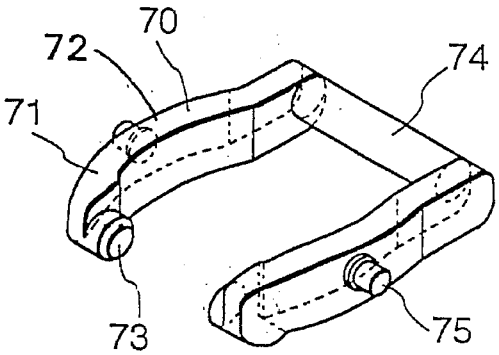
FIG. 8 is a perspective view showing an inner link in the key switch of the invention.
Figure 9:
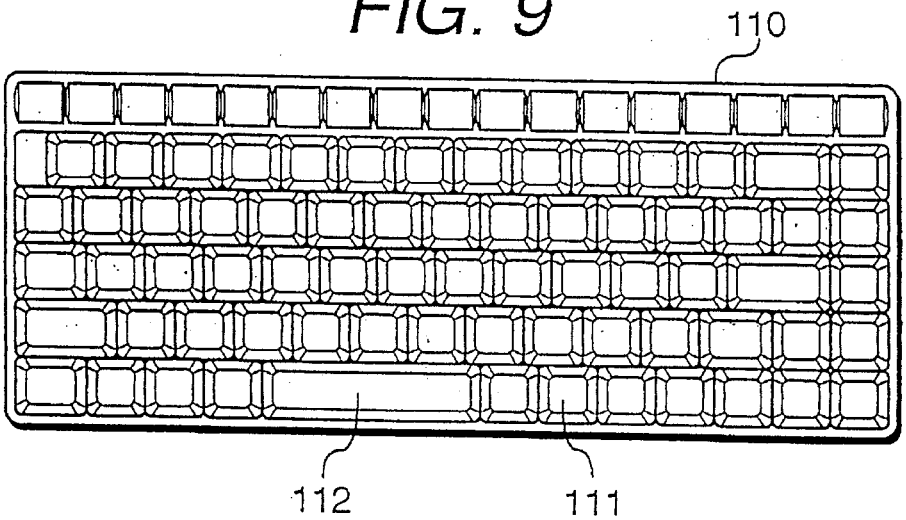
FIG. 9 is a plan view of a keyboard unit according to the invention.
Figure 10:
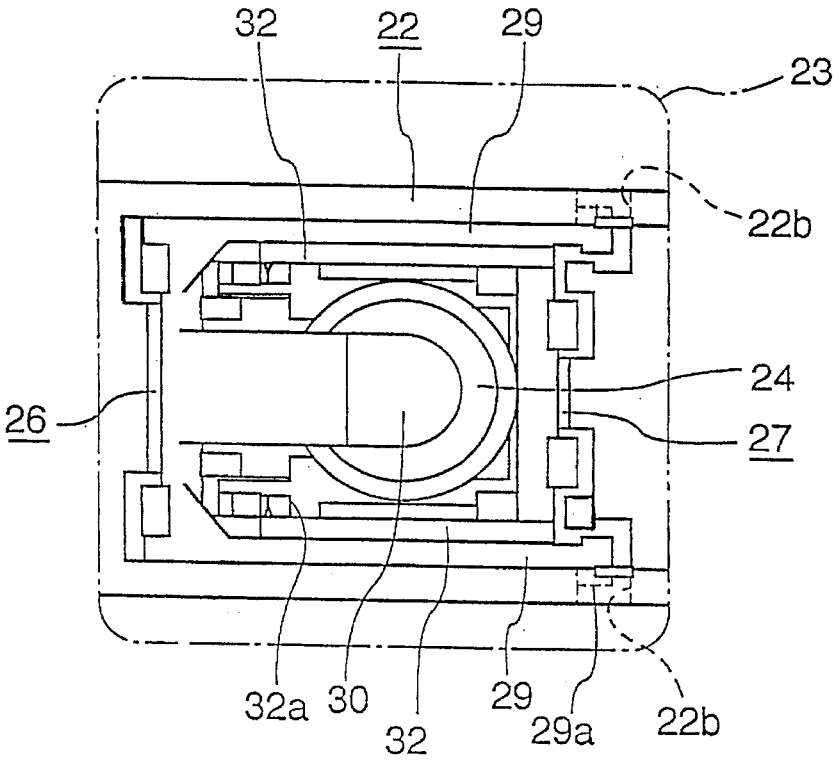
FIG. 10 Prior Art
FIG. 10 is a plan view showing the internal structure of a conventional key switch.
Figure 11:
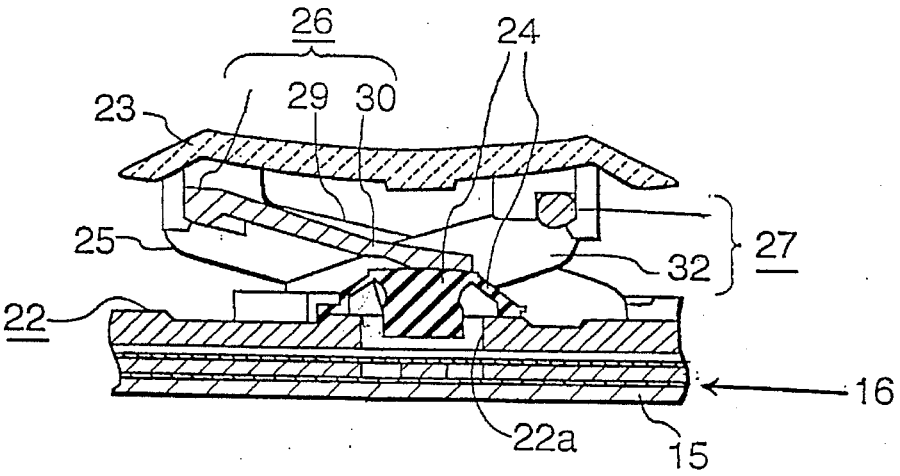
FIG. 11 Prior Art
FIG. 11 is a sectional view outlining the arrangement of the conventional key switch.

The inner link 70 is formed by injection-molding of synthetic resin such as polyacetal resin. The inner link 70, as shown in FIGS. 6 and 8, is also U-shaped, having the pair of arm portions 71 extended from both end of the cylindrical bridging portion 74. Each of the arm portions 71 includes an arcuate portion 72 which is moderately curved outwardly. The arcuate portions 72 make it possible to increase the size of the elastic member 51, preventing the permanent set in fatigue of the latter.

The arm portions 71 of the inner link 70 have a pair of a cylindrical end portion 73 at the ends, respectively, which are slidably held in elongated holes 104 formed in the slidably fixing portions 102 of the frame 100, respectively. The bridging portion 74 of the inner link 70 is rotatably held by the rotatably holding portions 42 of the key top 40.

As was described before, the arm portions 71 have the cylindrical protrusions 75, which are engaged with the through-holes 66 of the outer link 60. That is, the outer link 60 and the inner link 70 are coupled to each other at the intersection to form the cross link structure 80. The arm portions 71 are shorter than the arm portions 61, and therefore the cross link structure 80 can be folded flat, which contributes to a reduction of the thickness of the key switch.

Figure 12:
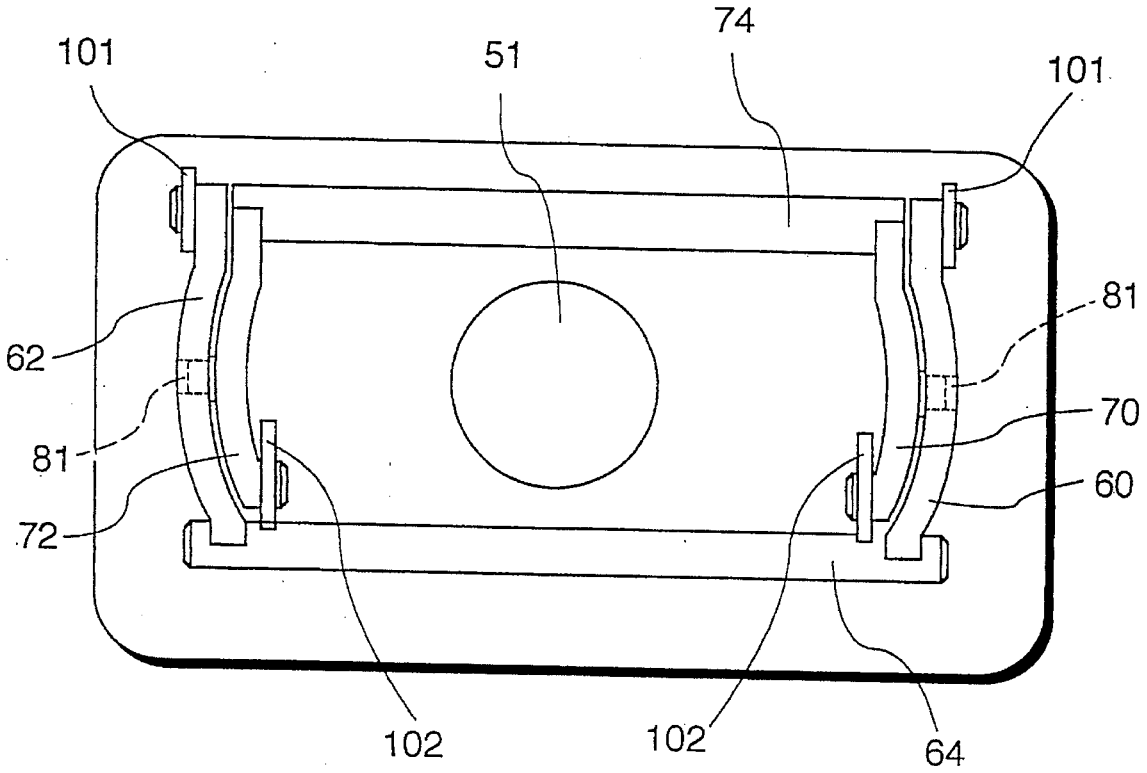
FIG. 12 is a plan view showing the internal structure of the modified key switch according to the invention.

In the case of a key switch 112 in which the area of its key top is large with respect to an elastic member, the lengths of the bridging portions 64 and 74, and/or the lengths of the arm portions 61 and 71 should be determined from the size of the key top. FIG. 12 shows an example of such structure. In this case, the interlocking bar can be eliminated which is heretofore employed to make the operation of the key switch smooth, which reduces the manufacturing cost and the part cost.

The membrane switch sheet 90 is a kind of switching element in which movable contacts provided on the lower surface of a flexible upper sheet are confronted through an insulating spacer with stationary contacts provided on the upper surface of the lower sheet. That is, the membrane switch sheet 90 has a plurality of switch sections in correspondence to the depressing portions, which are formed according to the arrangement of the key switches 111 of the keyboard unit 110 shown in FIG. 9. The membrane switch sheet 90 has holes through which the rotatably fixing portions 101 and the slidably fixing portions 102 of the frame 100 pass.

The frame 100 is formed by pressing a rigid metal plate such as an aluminum plate. The frame 100, as shown in FIG. 1, is placed under the membrane switch sheet 90. As was described before, the frame 100 includes the pair of rotatably fixing portions 101, and the pair of slidably fixing portions 102. The rotatably fixing portions 101 are each formed as follows: A cut is made in the metal plate to define the rotatably fixing portion 101, and the rotatably fixing portion 101 thus defined is raised. The slidably fixing portions 102 are also formed in the same manner.

The rotatably fixing portions 101 have the round holes 103, in which the cylindrical end portions 63 are rotatably held. The slidably fixing portions 102 have the elongated holes 104 in which the end portions 73 are slidably held. The cross link structure 80 is mounted on the frame 100 by utilization of the elasticity of the arm portions 61 and 71. A number of the rotatably fixing portions 101 and a number of the slidably fixing portions 102 are formed according to the arrangement of the key switches 111 on the keyboard unit 110.

The configurations of the rotatably fixing portions 101 and the slidably fixing portions 102 are not always limited to those which have been shown in the figures. That is, their configurations may be freely changed as long as the end portions 73 are slidably held thereby and the end portions 63 are rotatably held thereby. In addition, they may be so modified that the end portions 73 are rotatably held, and the end portions 63 are slidably held.

The material of the frame 100 is not always limited to that which is employed by the embodiment. For instance, it may be formed by molding of synthetic resin to have the required rigidity.

The keyboard unit 110 is assembled as follows: First, the membrane switch sheet 90 is placed on the frame 100, and then the rubber sheet 50 is placed on the membrane switch sheet 90. Next, the cross link structures 80 which have been assembled are engaged with the round holes 103 of the rotatably fixing portions 101 protruded through the rubber sheet 50 and with the elongated holes 104 of the slidably fixing portions 102 which are also protruded through the rubber sheet 50. Under this condition, the key tops 40 are assembled to complete the key switches 111 on the keyboard unit 110. Thus, the keyboard unit 110 has been assembled.

In the key switch of the invention, the cross link structure is supported by the pair of rotatably fixing portions and the pair of slidably fixing portions which are raised from the rigid frame under the membrane sheet and protruded over the elastic member. Hence, the key switch of the invention, unlike the conventional one, can dispense with the housing (22) provided above the membrane switch sheet. Accordingly, the key switch can be reduced in thickness, and the number of components can be decreased, with results that the manufacturing cost is decreased, and the number of part management steps is reduced.

In the case of a key switch in which the area of its key top is large with respect to an elastic member, the interlocking bar which is a substantially U-shaped metal wire can be eliminated which is heretofore employed to make the operation of the key switch smooth, which reduces the manufacturing cost and the part cost.

Further, since the abutting portion formed on the lower surface of the key top abuts against the upper surface of the elastic member, the key switch of the invention can dispense with the operating piece which is provided for the cross link structure of the conventional key switch, and accordingly it is possible to reduce the thickness of the keyboard unit. The click action which the elastic member performs in response to the tapping of the key top is directly transmitted to the operator.

In the key switch in which the frame is made of a metal sheet, the thickness thereof can be further reduced in comparison to one which is made of synthetic resin.

Since a plurality of elastic members are formed on the integral, one-piece rubber sheet, it is possible not only eliminate the troublesome operation that the elastic members are assembled in the key switches 111, respectively, and accordingly the likelihood that the elastic members are failed to be assembled in the key switch, but also to decrease the manufacturing cost. In addition, the number of components is greatly decreased, with results that the part cost is decreased as much, and the part management cost is also reduced.

The arm portions of the outer link, and the arm portions of the inner link have the arcuate portions, which makes it possible to increase the size of the elastic member, with a result that the latter is prevented from the permanent set in fatigue.

What is claimed is:

1. A key switch comprising:

a key top;

an elastic member in the form of a cup set upside down, which urges said key top upwardly;

a cross link structure made up of a substantially U-shaped outer link and a substantially U-shaped inner link which are rotatably coupled to each other at intersections, said cross link structure being rotatably supported below said key top;

a membrane switch sheet arranged under said elastic member and having a switch section which is confronted with a depressing portion of said elastic member; and a rigid frame arranged under said membrane switch sheet, wherein:

said key top is vertically guided by said cross link structure in such a manner that said key top is moved parallel, thereby to cause said depressing portion to turn on and off said switch section;

said key top has an abutting portion on the lower surface thereof, which abuts against the upper surface of said elastic member;

said outer link includes a pair of arm portions whose end portions are supported by a pair of rotatably fixing portions which are raised from said frame and protruded over said membrane switch sheet; and said inner link includes a pair of arm portions whose end portions are supported by a pair of slidably fixing portions which are raised from said frame and protruded over said membrane switch sheet.

2. A key switch as claimed in claim 1, wherein said frame is made of a metal sheet, said end portions of said outer link are rotatably held in round holes formed in said rotatably fixing portions raised from said frame;

said outer link includes a bridging portion having a pair of holding portions at both ends which are slidably held by a pair of slidably holding portions formed on the lower surface of said key top;

said end portions of said inner link are slidably held in a pair of elongated holes formed in said slidably fixing portions raised from said frame; and said inner link includes a bridging portion which is rotatably supported by a pair of rotatably holding portions formed on the lower surface of said key top.

3. A key switch as claimed in claim 1, wherein:

said elastic member of said key switch is integrally provided on a one-piece rubber sheet.

4. A key switch as claimed in claim 1, wherein:

said arm portions of said outer link include arcuate portions, respectively; and said arm portions of said inner link include arcuate portions along said arcuate portions of said arm portions of said outer link, respectively.

* * * * *